US011779979B2

(12) United States Patent
Ziegler

(10) Patent No.: US 11,779,979 B2
(45) Date of Patent: Oct. 10, 2023

(54) METHODS FOR HEATING STRIP PRODUCT

(71) Applicant: MATERION CORPORATION, Mayfield Heights, OH (US)

(72) Inventor: Karl R. Ziegler, Mayfield Heights, OH (US)

(73) Assignee: Materion Corporation, Mayfield Heights, OH (US)

( * ) Notice: Subject to any disclaimer, the term of this patent is extended or adjusted under 35 U.S.C. 154(b) by 460 days.

(21) Appl. No.: 17/271,546

(22) PCT Filed: May 6, 2019

(86) PCT No.: PCT/US2019/030855

§ 371 (c)(1),
(2) Date: Feb. 25, 2021

(87) PCT Pub. No.: WO2019/217279

PCT Pub. Date: Nov. 14, 2019

(65) Prior Publication Data

US 2021/0245217 A1 Aug. 12, 2021

Related U.S. Application Data

(60) Provisional application No. 62/668,471, filed on May 8, 2018.

(51) Int. Cl.
*B21B 45/00* (2006.01)
*B21B 1/22* (2006.01)

(52) U.S. Cl.
CPC ..... *B21B 45/004* (2013.01); *B21B 1/22* (2013.01); *B21B 2001/225* (2013.01)

(58) Field of Classification Search
CPC ..... B21B 45/004; B21B 2003/001; B21B 2001/225; B21B 1/22
See application file for complete search history.

(56) References Cited

U.S. PATENT DOCUMENTS 5,195,344 A * 3/1993 Masuda ..... B21B 1/34 72/200
6,033,622 A * 3/2000 Maruyama ..... B22F 1/18 427/217
10,370,749 B2 * 8/2019 Hobbis ..... B21C 47/3433
(Continued)

FOREIGN PATENT DOCUMENTS

CN 102653000 A 9/2012
CN 103658171 B 2/2016
(Continued)

OTHER PUBLICATIONS

Gong et al., "Fundamentals of Plate and Strip Rolling", Northeastern University Press, Jun. 2015, p. 29.
(Continued)

*Primary Examiner* — Bobby Yeonjin Kim
(74) *Attorney, Agent, or Firm* — Cozen O'Connor

(57) ABSTRACT

Systems and methods for reducing the thickness of a strip of an aluminum-based material are disclosed. The aluminum-based material is pre-heated before running the material through a warm rolling process. The systems include devices for pre-heating, which can include a heated payoff station or a dedicated pre-heating station that applies heated rolls or acts as a heated tunnel.

11 Claims, 6 Drawing Sheets

(56) References Cited

U.S. PATENT DOCUMENTS

| | | | | |
|---|---|---|---|---|
| 2001/0000491 | A1 | 6/2001 | Yasuhara et al. | |
| 2010/0098580 | A1* | 4/2010 | Matsuoka | C22F 1/00 164/76.1 |
| 2015/0211107 | A1* | 7/2015 | Li | C22F 1/18 72/46 |
| 2016/0273080 | A1* | 9/2016 | Tarrant | C22C 1/1084 |

FOREIGN PATENT DOCUMENTS

| | | | |
|---|---|---|---|
| EP | 1001041 | A1 | 5/2000 |
| JP | H08238517 | A1 | 9/1996 |
| WO | 2009054075 | A1 | 4/2009 |

OTHER PUBLICATIONS

International Application No. PCT/US2019/030855, International Search Report dated Aug. 2, 2019, 2 pages.

* cited by examiner

METHODS FOR HEATING STRIP PRODUCT

CROSS-REFERENCE TO RELATED APPLICATIONS

This application claims priority to U.S. Provisional Patent Application Ser. No. 62/668,471, filed May 8, 2018, the entirety of which is incorporated by reference herein.

BACKGROUND

The present disclosure relates to methods for producing strip product from various metal matrix composites (MMC), and systems for practicing such methods. In particular, a metal input is pre-heated to a warm rolling temperature, and then warm rolled to reduce the thickness of the metal input and produce a metal strip.

BRIEF DESCRIPTION

Reducing the thickness of various composite MMC materials (particularly aluminum alloys) via cold working is relatively slow due to their relatively low ductility at room temperature, which results in the formation of cracks and thus limits the degree of thickness reduction that can occur. Cracking can be avoided in these alloys by the systems and methods of the present disclosure, which pre-heat the metal material to be less susceptible to cracking during a warm rolling (reduction) process. Systems and devices are disclosed herein for performing such pre-heating. These devices can also be used to retro-fit existing rolling mills.

Disclosed herein are various methods for reducing a thickness of an input of a metal material, comprising: pre-heating the input to a warm rolling temperature that is less than one-half the melting point of the metal material; and warm rolling the pre-heated input in a rolling mill to reduce the thickness of the input, resulting in a metal strip having a final thickness.

In some embodiments, the pre-heating is performed by heating a payoff station from which the input is directed towards the rolling mill. In other embodiments, the pre-heating is performed by running the input through a heated tunnel, wherein the heated tunnel provides heat to the input via conduction, convection, or radiation. In alternative embodiments, the pre-heating is performed by contacting a top surface and a bottom surface of the input with heated rolls, wherein the heated rolls do not substantially reduce the thickness of the input.

The warm rolling temperature may be from about 350° F. to about 600° F. (about 177° C. to about 315° C.). The warm rolling may be performed to a total % WW of at least 75%. The warm rolling may be performed by a plurality of warm passes, each warm pass resulting in a % WW of up to 65%.

The rolling mill may comprise a set of heated bite rolls. In some further embodiments, the metal strip is also wound into a coil.

In particular embodiments, the metal material is a metal matrix composite (MMC) material that comprises an aluminum alloy and ceramic particles dispersed in the aluminum alloy. The ceramic particles may comprise at least one ceramic material selected from the group consisting of carbides, oxides, silicides, borides, and nitrides. The MMC material may comprise from about 15 vol % to about 50 vol % of the ceramic particles. The average particle size of the ceramic particles may be from about 0.3 μm to about 5 μm.

Also disclosed herein are metal strips produced by these methods, and articles produced from such metal strips.

Also disclosed in various embodiments are systems for producing metal strip, comprising: means for pre-heating a metal input to a warm rolling temperature that is less than one-half the melting point of the metal material; and a rolling mill for warm rolling the pre-heated metal input to produce the metal strip.

The means for pre-heating can be a payoff station that is configured (A) to feed the metal input to the rolling mill and (B) to pre-heat the metal input. In other embodiments, the means for pre-heating can be a heated tunnel located between a payoff station and the rolling mill, wherein the heated tunnel provides heat to the input via conduction, convection, or radiation. In yet other embodiments, the means for pre-heating can be a set of heated rolls located between a payoff station and the rolling mill, wherein the heated rolls are located so that a top surface and a bottom surface of the metal input are contacted by the heated rolls. The system may further comprise a take-up reel downstream of the rolling mill.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
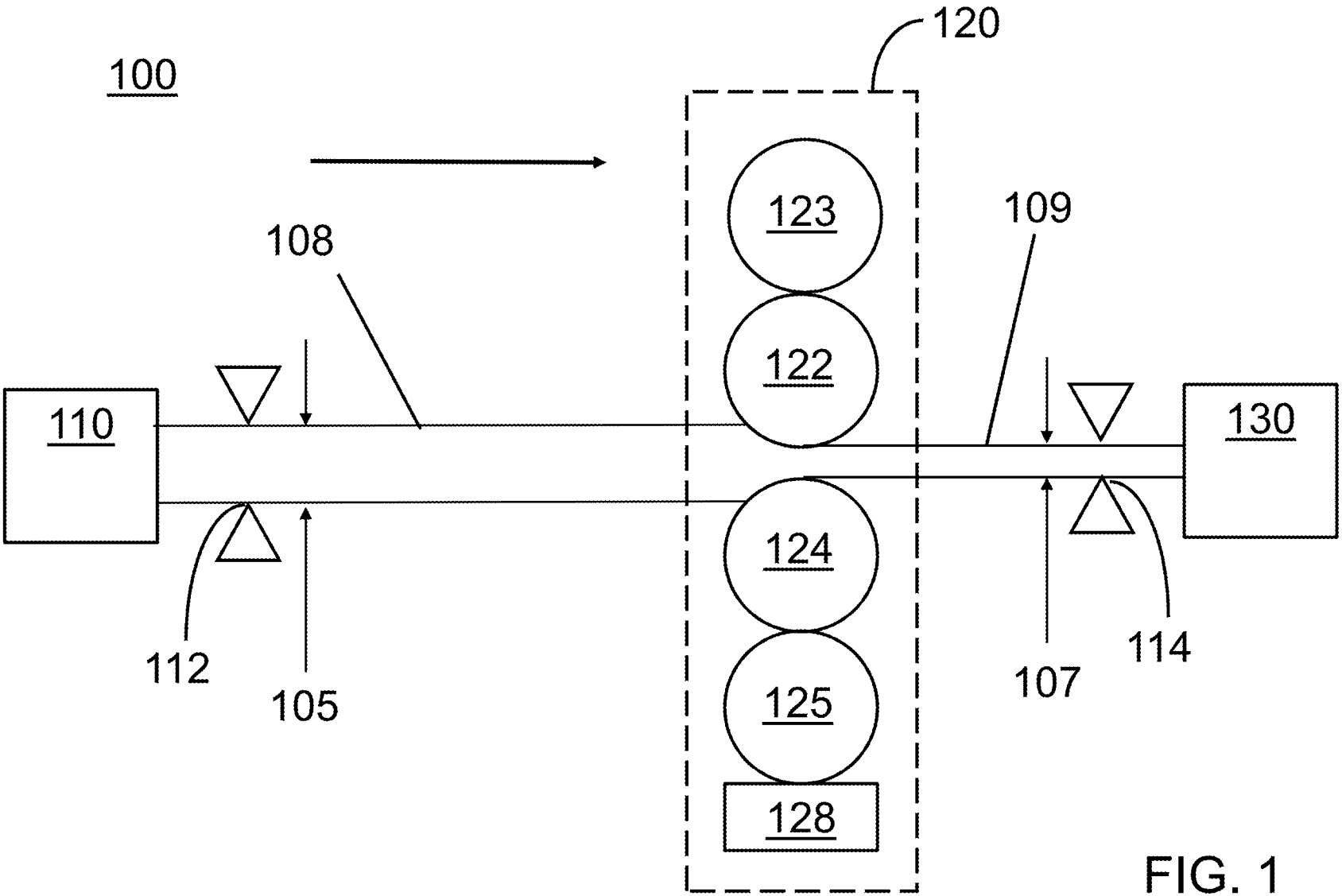
FIG. 1 is a first exemplary embodiment of a system of the present disclosure for pre-heating and then warm rolling a metal input. Here, the pre-heating is performed at the payoff station.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/components/steps and permit the presence of other ingredients/components/steps. However, such description should be construed as also describing compositions, articles, or processes as "consisting of" and "consisting essentially of" the enumerated ingredients/components/steps, which allows the presence of only the named ingredients/components/steps, along with any impurities that might result therefrom, and excludes other ingredients/components/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The term "about" can be used to include any numerical value that can vary without changing the basic function of that value. When used with a range, "about" also discloses the range defined by the absolute values of the two endpoints, e.g. "about 2 to about 4" also discloses the range "from 2 to 4." The term "about" may refer to plus or minus 10% of the indicated number.

The present disclosure relates to materials having an average particle size. The average particle size is defined as the particle diameter at which a cumulative percentage of 50% (by volume) of the total number of particles are attained. In other words, 50% of the particles have a diameter above the average particle size, and 50% of the particles have a diameter below the average particle size. The size distribution of the particles will be Gaussian, with upper and lower quartiles at 25% and 75% of the stated average particle size, and all particles being less than 150% of the stated average particle size.

The present disclosure may refer to temperatures for certain process steps. In the present disclosure, the temperature usually refers to the temperature attained by the material that is referenced, rather than the temperature at which the heat source (e.g. furnace, oven) is set. The term "room temperature" refers to a range of from 68° F. (20° C.) to 77° F. (25° C.).

The term "bar" refers to a piece of material with a rectangular cross-section having a thickness of greater than 0.48 mm. The term "plate" refers to a piece of material with a rectangular cross-section having a thickness greater than 4.78 mm. The term "strip" refers to a piece of material with a rectangular cross-section having a thickness of 4.78 mm or less. The term "slab" refers to a piece of material that has a rectangular cross-section, and may be used interchangeably with the word "input" to refer to the starting piece of material that is worked by the processes of the present disclosure into a strip that can be coiled.

The term "coil" refers to a length of material that is wound into coil form, and may also be called a roll of material.

Rolling, as used herein, is a metal forming process in which a stock input is passed through one or more pairs of rollers to reduce the thickness of the stock input.

The terms "upstream" and "downstream" are relative to the direction in which a metal input flows through various system components, i.e. the metal input travels through an upstream component prior to traveling through the downstream component.

The present disclosure relates to systems and methods for reducing the thickness of an input of a metal matrix composite material to form strip from the input. This is done by pre-heating the input, and then warm rolling the input to obtain the strip.

Generally, the metal material that forms the input is a metal matrix composite (MMC), which is a composite material that includes a metal matrix and reinforcement particles dispersed in the metal matrix. The metal matrix phase is typically continuous, whereas the reinforcing particles form a dispersed phase within the metal matrix phase.

In particular embodiments, the matrix phase is formed from aluminum or an aluminum alloy. The reinforcement particles are a ceramic material selected from carbides, oxides, silicides, borides, and nitrides. Specific reinforcement particles include silicon carbide, titanium carbide, boron carbide, silicon nitride, titanium nitride, and zirconium oxide. In particular embodiments, silicon carbide is used.

The reinforcement particles may have an average particle size (D50) in the range of from 0.3 micrometers (μm) to 5 μm, including about 3 μm. The average particle size is defined as the particle diameter at which a cumulative percentage of 50% by volume (vol %) of the total volume of particles are attained. In other words, 50 vol % of the particles have a diameter above the average particle size, and 50 vol % of the particles have a diameter below the average particle size.

The MMC may include from about 10 vol % to about 50 vol % of the reinforcement particles, including from about 15 vol % to about 30 vol % and from about 30 vol % to about 50 vol %.

The aluminum alloy used in the MMC may be a 2000 series aluminum alloy (i.e., aluminum alloyed with copper), a 6000 series aluminum alloy (i.e., aluminum alloyed with magnesium and silicon), or a 7000 series aluminum alloy (i.e., aluminum alloyed with zinc). Non-limiting examples of suitable aluminum alloys include 2009, 2124, 2090, 2099, 6061, and 6082.

In some embodiments, the aluminum alloy includes from about 91.2 wt % to about 94.7 wt % aluminum, from about 3.8 wt % to about 4.9 wt % copper, from about 1.2 wt % to about 1.8 wt % magnesium, and from about 0.3 wt % to about 0.9 wt % manganese.

In other embodiments, the aluminum alloy includes from about 95.8 wt % to about 98.6 wt % aluminum, from about 0.8 wt % to about 1.2 wt % magnesium, and from about 0.4 wt % to about 0.8 wt % silicon.

In some particular embodiments, an MMC includes 6061 series or 2124 series aluminum alloy reinforced with about 10 vol % to about 50 vol % of silicon carbide particles, including from about 15 vol % to about 30 vol % and from about 30 vol % to about 50 vol % of silicon carbide particles.

In more particular embodiments, the MMC material can be made from a 6061 aluminum alloy reinforced with 40 vol % silicon carbide particles. Physical properties of 6061 aluminum alloy reinforced with 40 vol % silicon carbide particles include:

| Physical Properties | |
|---|---|
| Density, g/cm$^3$ (lbs/in$^3$) | 2.9 (0.105) |
| Elastic Modulus, GPa (msi) | 140 (20.3) |
| Specific Stiffness, GPa/g/cm$^3$ | 48 |
| Poisson's Ratio | 0.3 |
| Thermal Conductivity @ 25° C. W/m° K (BTU/hr.ft. ° F.) | 130 (75) |
| Thermal Expansion @ 25° C. ppm/° C. (ppm/° F.) | 13 (7.4) |
| Solidus ° C. (° F.) | 570 (1058) |
| Specific Heat Capacity J/g/° C. (BTU/lb/° F.) | 0.800 (0.191) |

In other particular embodiments, the MMC material can be made from a 6061 aluminum alloy reinforced with 20 vol % silicon carbide particles. Physical properties of 6061 aluminum alloy reinforced with 20 vol % silicon carbide particles include:

| Physical Properties | |
|---|---|
| Density, g/cm$^3$ (lbs/in$^3$) | 2.8 (0.101) |
| Elastic Modulus, GPa (msi) | 103 (14.9) |
| Specific Stiffness, GPa/g/cm$^3$ | 36 |
| Poisson's Ratio | 0.3 |
| Thermal Conductivity @ 25° C. W/m° K (BTU/hr.ft. ° F.) | 150 (87) |
| Thermal Expansion @ 25° C. ppm/° C. (ppm/° F.) | 17 (9.4) |
| Solidus ° C. (° F.) | 570 (1058) |
| Specific Heat Capacity J/g/° C. (BTU/lb/° F.) | 0.850 (0.203) |

In additional embodiments, the MMC material can be made from a 2124 aluminum alloy reinforced with 25 vol % silicon carbide particles. Physical properties of 2124 aluminum alloy reinforced with 25 vol % silicon carbide particles include:

| Physical Properties | |
|---|---|
| Density, g/cm$^3$ (lbs/in$^3$) | 2.88 (0.104) |
| Elastic Modulus, GPa (msi) | 115 (16.7) |
| Specific Stiffness, GPa/g/cm$^3$ | 39 |
| Poisson's Ratio | 0.3 |
| Thermal Conductivity @ 25° C. W/m° K (BTU/hr.ft. ° F.) | 150 (87) |
| Thermal Expansion @ 25° C. ppm/° C. (ppm/° F.) | 16.1 (8.9) |
| Solidus ° C. (° F.) | 548 (1018) |
| Specific Heat Capacity J/g/° C. (BTU/lb/° F.) | 0.836 (0.200) |

In particular embodiments, the MMC material can be made from 2124 aluminum alloy reinforced with 17 vol % silicon carbide particles. Physical properties of 2124 aluminum alloy reinforced with 17 vol % silicon carbide particles include:

| Physical Properties | |
|---|---|
| Density, g/cm$^3$ (lbs/in$^3$) | 2.85 (0.103) |
| Elastic Modulus, GPa (msi) | 100 (14.5) |
| Specific Stiffness, GPa/g/cm$^3$ | 35 |
| Poisson's Ratio | 0.3 |
| Thermal Conductivity @ 25° C. W/m° K (BTU/hr.ft. ° F.) | 155 (90) |
| Thermal Expansion @ 25° C. ppm/° C. (ppm/° F.) | 16.8 (9.3) |
| Solidus ° C. (° F.) | 548 (1018) |
| Specific Heat Capacity J/g/° C. (BTU/lb/° F.) | 0.848 (0.203) |

In other embodiments, the MMC material can be made from 6063, 6082, 2009, or 2618 series aluminum alloys reinforced with about 10 vol % to about 50 vol % of silicon carbide particles, including from about 15 vol % to about 30 vol %, or from about 30 vol % to about 50 vol % of silicon carbide particles.

In some particular embodiments, the MMC material is made of 2009 series aluminum alloy reinforced with 15 vol % silicon carbide particles. Physical properties of 2009 series aluminum alloy reinforced with 15 vol % silicon carbide particles include:

| Physical Properties | |
|---|---|
| Density, g/cm$^3$ (lbs/in$^3$) | 2.86 (0.103) |
| Elastic Modulus, GPa (msi) | 96 (13.9) |
| Specific Stiffness, GPa/g/cm$^3$ | 33 |
| Poisson's Ratio | 0.3 |
| Thermal Conductivity @ 25° C. W/m° K (BTU/hr.ft. ° F.) | 155 (90) |
| Thermal Expansion @ 25° C. ppm/° C. (ppm/° F.) | 18 (10.0) |
| Solidus ° C. (° F.) | 548 (1018) |
| Specific Heat Capacity J/g/° C. (BTU/lb/° F.) | 0.848 (0.203) |

The input MMC materials are generally made via powder metal production (including, but not limited to, powder metallurgy and high energy mixing processes). The MMC materials of the present disclosure can be made by mixing the aluminum alloy with reinforcement particles to form a mixture. The mixture is consolidated, compacted and extruded or hot rolled. This process creates a rectangular product, i.e. a slab, which can be used as the input into the processes of the present disclosure.

For example, metal powder and ceramic particles may be mixed with a high energy technique to distribute the ceramic reinforcement particles into the metal matrix. Suitable techniques for this mixing include ball milling, mechanical attritors, teamer mills, rotary mills and other methods to provide high energy mixing to the powder constituents. Mechanical alloying should be completed in an atmosphere to avoid excessive oxidation of powders. For example, an inert atmosphere can be provided using nitrogen or argon gas. The processing parameters should be selected to achieve an even distribution of the ceramic particles in the metallic matrix.

The powder from the high energy mixing stage may be degassed to remove any retained moisture from the powder surface. This may be completed at between 37° C. and 500° C. (100° F. to 930° F.).

A hot compacting step may also be performed to increase a density of the reinforced composite structure. The hot compacting steps may be performed at a temperature in the range of from about 750° F. (400° C.) to about 1112° F. (600° C.), including from about 795° F. (425° C.) to about 1020° F. (550° C.) and about 930° F. (500° C.). Hot compaction may include the use of hot die compaction, hot isostatic pressing or hot extrusion typically at pressures of between 30 to 150 MPa.

The mixture is consolidated by hot isostatic pressing (HIP). In the HIP process, the powder is exposed to both elevated temperature and high gas pressure in a high pressure containment vessel to turn the powder into a compact solid. The isostatic pressure is omnidirectional. The HIP process eliminates voids and pores. The hot isostatic pressing may be performed at a temperature of 660° F. (350° C.) to 1110° F. (600° C.) and a pressure of 30 to 150 MPa sufficient to allow the metal section to reach the required temperature, typically between 1 hour and 8 hours. The hot isostatic pressing may be performed on commercially available aluminum alloy, steel, or nickel HIP systems.

As previously mentioned, some MMC materials exhibit limited ductility at room temperature. This means the material has a limited ability to deform under pressure or compressive stress, such as the stresses which are applied to the input material during rolling. Processing these materials by conventional methods to produce strip having a reduced thickness results in cracking about the edges of the material. This severely limits the ability to economically produce thin gauge strip. The cracks are caused by the lower ductility of the metal materials at room temperatures as well as the build-up of cold work in the material.

The ductility of the metal material can be improved by pre-heating the metal material before subjecting it to rolling. Several things happen to the material when the temperature is increased. First, the strength of the material is decreased, allowing for more reduction per a given load of material in the rolling process. Second, the ductility of the metal material increases with temperature. At temperatures around one-half of the melting point of the metal material, the microstructure of the metal material can recover and recrystallize from rolling induced deformation. This can occur in the time between rolling passes. Effectively, the material is annealed between passes, in situ. The degree of recrystallization depends on the percent reduction and the speed of the material through the mill. This allows one to achieve much larger total deformations than are possible at lower temperatures.

FIG. 1 is a first exemplary embodiment of a system 100 that can be used to reduce the thickness of the metal input to obtain a strip product formed from the metal input. The system 100 includes a payoff station 110 and a rolling mill 120. The payoff station provides the metal input to the rolling mill 120. The metal input can be provided as batches of slab, plate or strip. Alternatively, the metal input can be provided as a coil of metal material. As illustrated here, the metal input begins at the left-hand side of the figure, and advances in the direction of the arrow to the right-hand side of the figure.

In some embodiments, the thickness of the metal input may be measured at point 112, which is prior to entering the rolling mill 120. The measurement may be made by a gauge, sensor, or the like. The thickness of the metal input is indicated with reference numeral 105. This can also be considered an "initial thickness" or a "starting thickness".

The metal input is pre-heated to a warm rolling temperature before entering the rolling mill 120. The warm rolling temperature is greater than room temperature, and is usually at least 300° F. (149° C.). The warm rolling temperature is less than one-half the melting point of the metal material from which the input is made. In more specific embodiments, the warm rolling temperature is from about 350° F. (177° C.) to about 600° F. (316° C.).

In FIG. 1, the metal input is pre-heated to a warm rolling temperature in the payoff station 110. In this embodiment, the payoff station can act as an oven or furnace, in addition to sending the input through the system 100. Reference numeral 108 is used to indicate the pre-heated metal input. The metal input should be heated to the warm rolling temperature throughout its entire thickness.

Continuing, the pre-heated metal input 108 is then fed from the pre-heating station 110 into the rolling mill 120. Here, the pre-heated material 108 is reduced in thickness by a pair of bite rolls 122 and 124. In some embodiments, the bite rolls 122 and 124 are pressed together by a pair of back-up rolls 123 and 125 in the conventional manner. The back-up rolls 123 and 125 are supported in chocks (not shown), and they are mechanically controllable to vary the gap between the bite rolls. In some embodiments, at least one of the bite rolls or back up rolls is mechanically connected to a main drive motor that drives the material through the mill 120. The bite rolls 122, 124 press against the preheated metal input 108 with the pressure necessary to maintain a preselected nip width. The rolling mill 120 may also include a nip width controller 128 that controls the actual pressure which the bite rolls 122, 124 apply to the pre-heated metal input 108 and hence the thickness of the metal strip exiting the rolling mill 120. The final strip product exiting the rolling mill 120 is indicated with reference numeral 109.

The reduction in thickness (% WW) of the input material in the warm rolling of the rolling mill 120 may vary. The metal input may be hot rolled with up to 30% reduction in thickness per rolling pass. In some embodiments, the thickness reduction per pass is from about 5% to about 30%. In other embodiments, the thickness reduction per pass is from about 10% to about 30%. In some embodiments, the hot rolling thickness reduction per pass may be from about 10% to about 25%. It is also noted that only one set of bite rolls is illustrated here, but the rolling mill can contain additional bite rolls, such that the metal input is reduced in thickness multiple times. The total reduction (% WW) in the rolling mill, i.e. after all warm rolling passes are completed, is at least 75% of the initial thickness of the metal input.

The warm rolling process is advantageous because it eliminates or at least greatly reduces the presence of cracks in the metal input. Moreover, the warm rolling process allows larger reductions in the thickness of the metal input per pass in the rolling mill compared to cold working. The relatively low rolling temperature, compared to hot rolling temperatures, limits the oxidation of the metal input, which is usually more susceptible to rapid oxidation at hot rolling temperatures.

In some embodiments, the thickness of the final strip 109 may be measured at point 114, which is downstream of the rolling mill 120. The measurement may be made by a gauge, a sensor, or the like. The thickness of the final strip is indicated with reference numeral 107. This can also be considered a "final thickness" or an "ending thickness". The final thickness 107 is less than the initial thickness 105. Desirably, the final thickness is less than 0.2 inches (0.51 mm). The width of the final strip may also be greater than the width of the metal input as well, though this is not required.

The strip 109 is then collected at a collection station 130. The length and width of the strip product is not particularly relevant.

Figure 2:
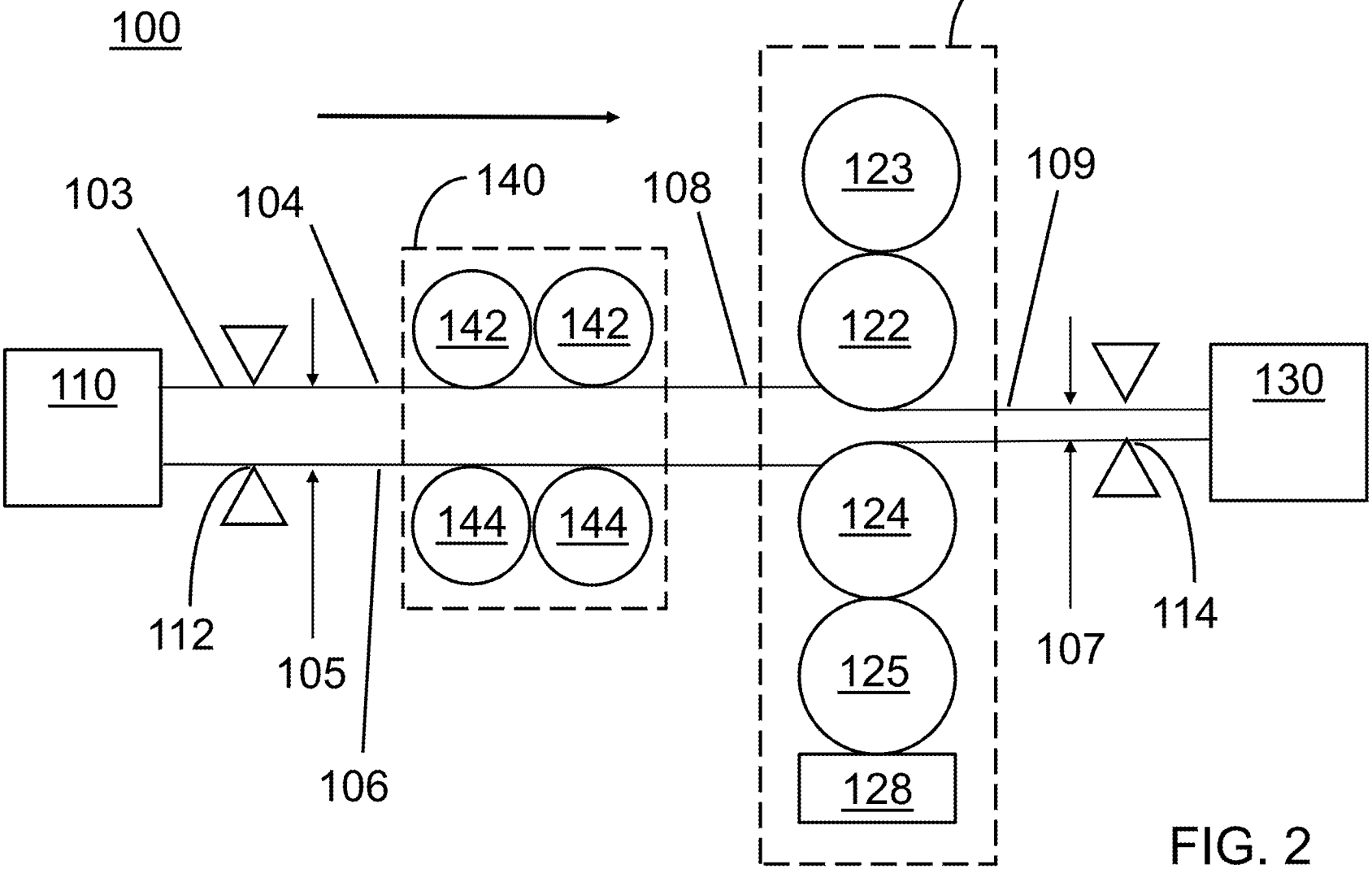
FIG. 2 is a third exemplary embodiment of a system of the present disclosure for pre-heating and then warm rolling a metal input. Here, the pre-heating is performed by a set of heated rolls between the payoff station and the rolling mill.

FIG. 2 is a second exemplary embodiment of a system 100 that can be used to reduce the thickness of the metal input to obtain a strip product formed from the metal input, and is similar to that of FIG. 1. In this embodiment, the system 100 includes a payoff station 110, a rolling mill 120, and a collection station 130 located as previously described. However, the pre-heating does not occur in the payoff station. Rather, the pre-heating occurs at a pre-heating station 140, which is located between the payoff station 110 and the rolling mill 120. The metal input, before being pre-heated, is identified with reference numeral 103, and is identified with reference numeral 108 after being pre-heated in the pre-heating station 140.

In FIG. 2, the pre-heating station 140 is in the form of at least one heated roll, or a set of heated rolls 142, 144. The heated rolls 142, 144 are wide enough to match or exceed the width of the metal input 103. Heated roll 142 contacts a top surface 104 of the metal input 103, and heated roll 144 contacts a bottom surface 106 of the metal input 103, respectively. The heated rolls 142, 144 may be heated by an internal heating element or other means. In some embodiments, the internal heating element is a resistive heating element. If desired, multiple heated rolls can contact each surface of the metal input. The heated rolls transfer heat to the metal input, taking advantage of the relatively high thermal conductivity of the aluminum alloy. Each heated roll may be set at the same temperature. In other embodiments having multiple heated rolls contacting a surface of the metal input, the heated rolls may be set at progressively higher temperatures as the metal input travels towards the rolling mill 120. It is noted that the heated rolls are set above the warm rolling temperature that is desired to be attained by the metal input. Again, the metal input should be heated to the warm rolling temperature throughout its entire thickness. It is also noted that in the pre-heating station 140, the thickness of the metal input is not substantially reduced by the heated rolls (i.e. by more than 3%).

Figure 3:
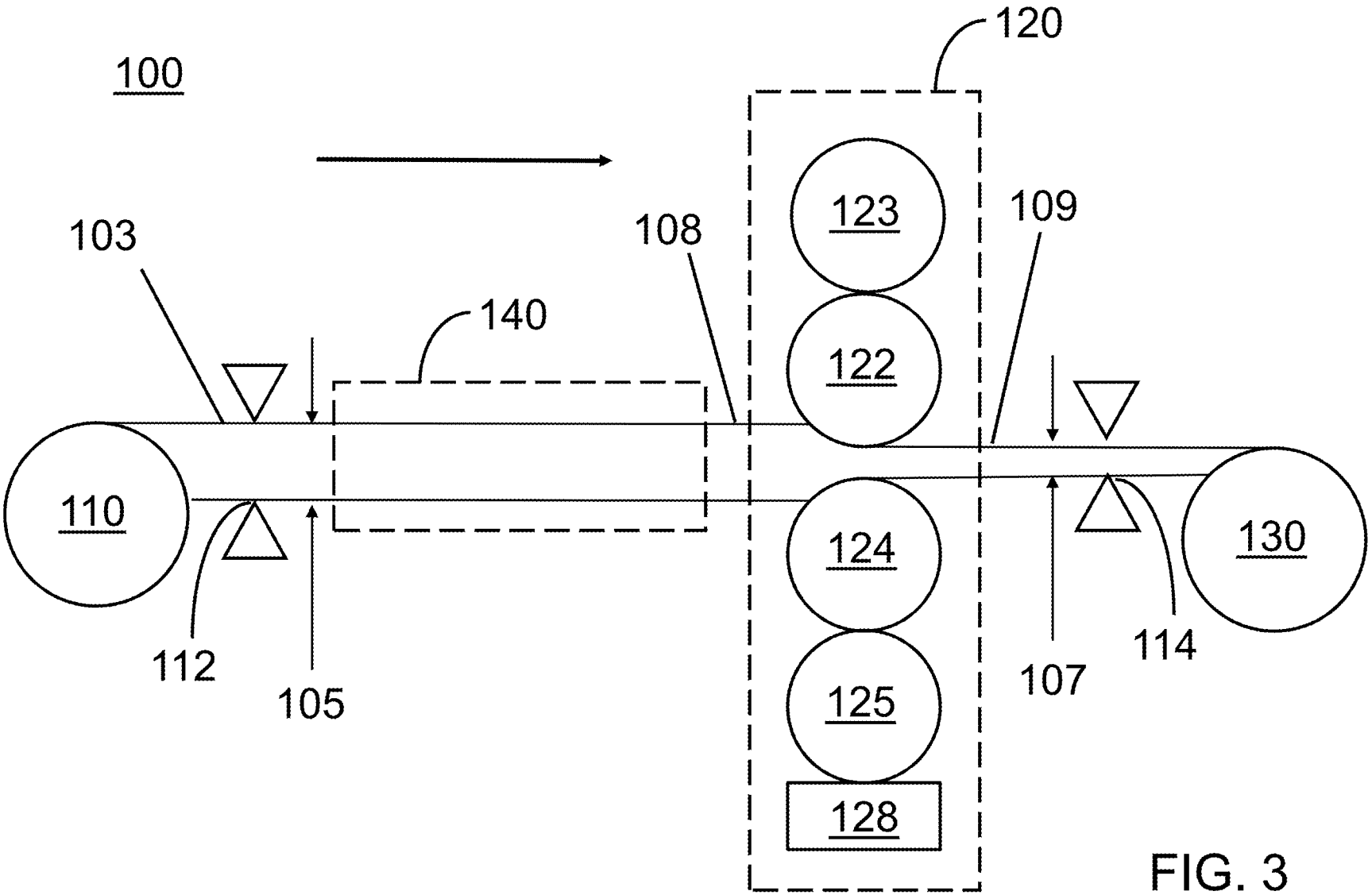
FIG. 3 is a second exemplary embodiment of a system of the present disclosure for pre-heating and then warm rolling a metal input. Here, the pre-heating is performed in a heated tunnel between the payoff station and the rolling mill.

FIG. 3 is a third exemplary embodiment of a system 100 that can be used to reduce the thickness of the metal input to obtain a strip product formed from the metal input, and is similar to that of FIG. 2. In this embodiment, the system 100 includes a payoff station 110, a rolling mill 120, a pre-heating station 140, and collection station 130.

As illustrated here, in some embodiments of the present disclosure, the payoff station 110 and the collection station 130 are adapted to accommodate a coil/reel/roll of metal input. The coil/reel/roll may be unwound and progressed forward, in the direction indicated by the arrow, through the system 100. This permits the thickness reduction process to be continuous in nature. That is, the payoff station 110 may continually feed the metal input from the coil/reel/roll. The final strip 109 can be continuously wound to form a coil of thinner strip (compared to the metal input).

In FIG. 3, the pre-heating station 140 is in the form of a heated tunnel through which the metal input 103 passes as it travels from the payoff station 110 to the rolling mill 120. The pre-heating station acts as an oven or furnace to heat the metal input to the warm rolling temperature. The heated tunnel may be in the form of an oven that acts by conduction, convection, or radiation. For example, the heated tunnel may be in the form of a gas oven, a combustion oven, or a convection oven. The oven can alternatively include a radiating heating element such as an infrared heater.

It should be noted that the pre-heating station 140 illustrated in FIG. 2 and FIG. 3 could be retro-fitted into existing rolling mills or similar devices and machinery.

It is also contemplated that in some embodiments, at least one bite roll 122, 124 within the rolling mill 120 can also be a heated roll. The bite roll may be heated with a resistive heating element located within the core of the roll, or by other means known in the art. This can maintain the warm rolling temperature of the metal input 108 within the rolling mill 120.

The final strip 109 has a smaller thickness compared to the metal input. The final strip can be further processed, or can then be used for high volume production of various articles and goods. Such articles may be useful in applications such as space, defense, aerospace, automotive, OEM, consumer goods, consumer electronics, and transportation applications. For example, the final strip can be stamped, cut, etc. to form the article. Articles can include outlet guide vanes; hydraulic/fuel blocks; wheels; fixed wing structures/skins; helicopter components; pistons; piston pins; cylinder liners; brake calipers; connecting rods; push rods; chassis components; optical sensors; and satellite structures.

The following examples are provided to illustrate the compositions, articles, and methods of the present disclosure. The examples are merely illustrative and are not intended to limit the disclosure to the materials, conditions, or process parameters set forth therein.

EXAMPLES

Comparative Example 1

Figure 4A:
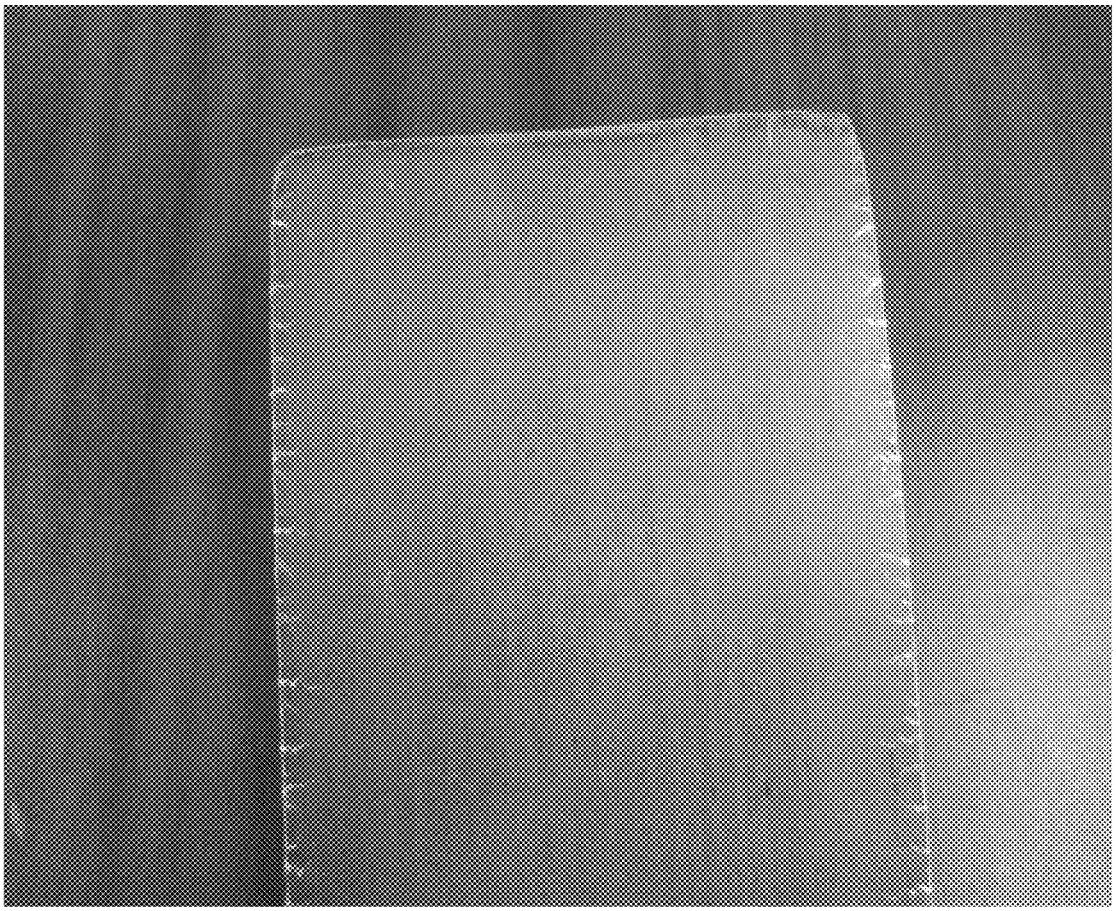
FIG. 4A and FIG. 4B are photographs of short strips of an MMC material that is only cold worked, and both strips exhibit cracking.
Figure 4B:
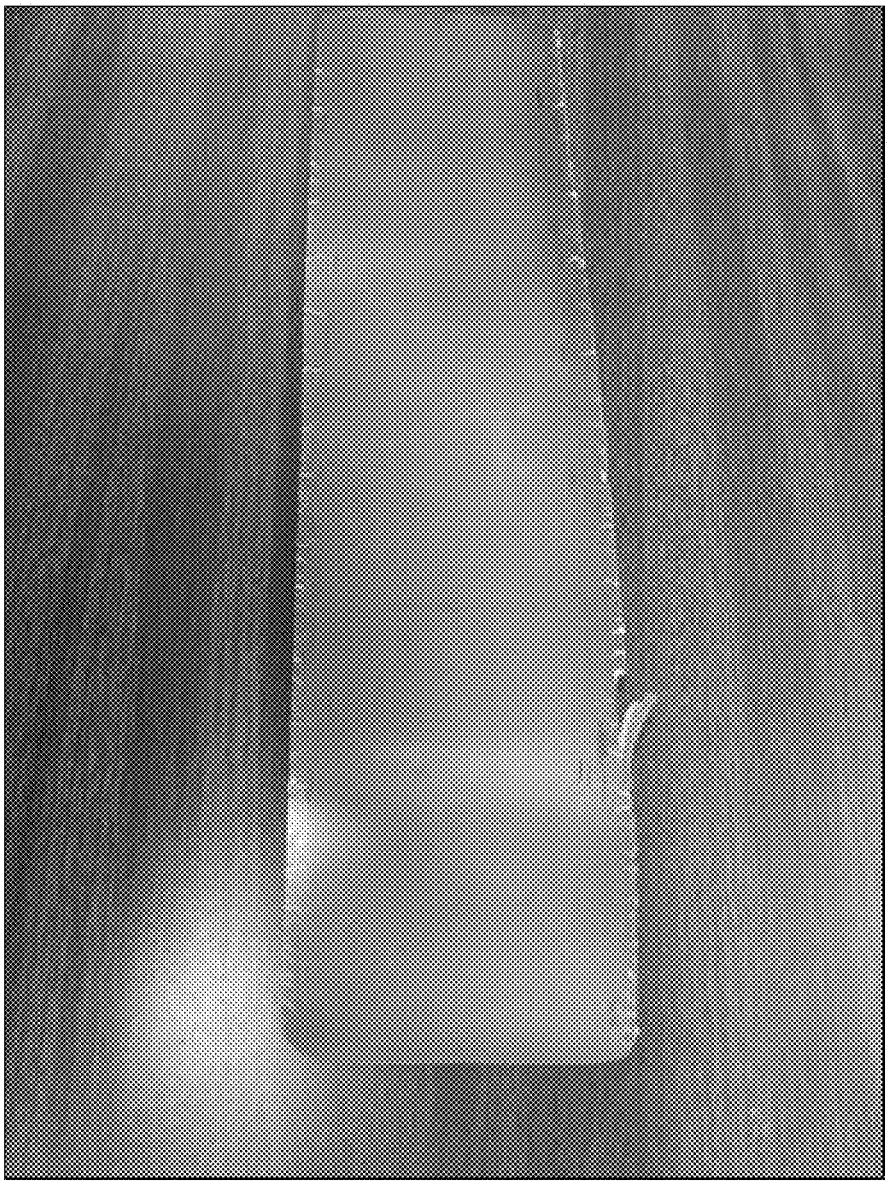

Pieces of an MMC made from 6061 aluminum alloy reinforced with 20 vol % of SiC particles were extruded at a thickness of 0.140 inches (3.55 mm), and cut to a width of 4.75 inches. The pieces were cold rolled at 10% CW per pass. As seen in FIG. 4A and FIG. 4B, edge cracking occurred.

Example 1

Figure 5:
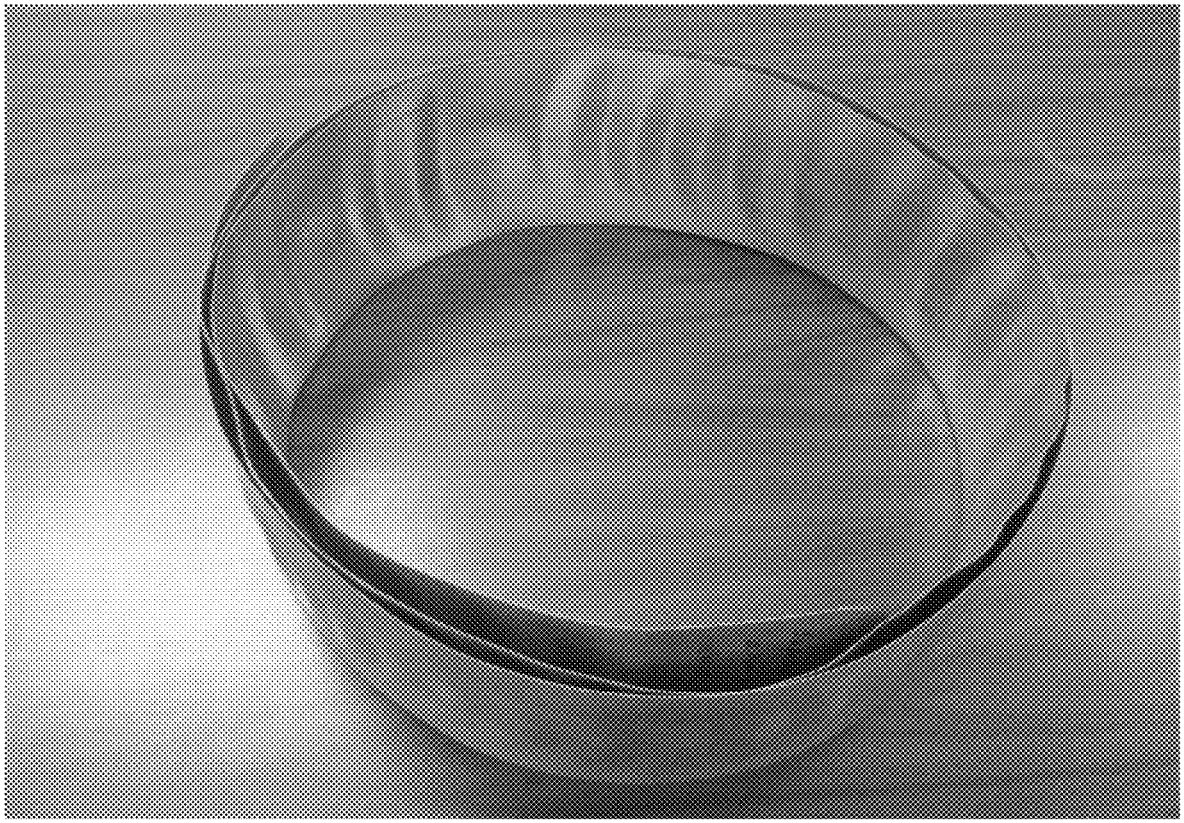
FIG. 5 is a photograph of a strip material processed in accordance with some embodiments of the present disclosure, and having enhanced properties.

Pieces of an MMC made from 6061 aluminum alloy reinforced with 20 vol % of SiC particles were extruded at a thickness of 0.140 inches (3.55 mm), and cut to a width of 4.75 inches. The pieces were warm rolled at temperatures between 450° F. and 550° F. to a thickness of 0.018 inch (0.46 mm), or a % WW of 87%, and a 4.75 inch width. As illustrated in FIG. 5, no cracks were present in the material, and the material was easily coiled.

It will be appreciated that variants of the above-disclosed embodiments and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims or the equivalents thereof.

The invention claimed is:

1. A method for reducing a thickness of an input of a metal material, comprising:

pre-heating the input to a warm rolling temperature that is less than one-half the melting point of the metal material and ranges from 350° F. to 600° F.;

warm rolling the pre-heated input in a rolling mill to reduce the thickness of the input, resulting in a metal strip having a final thickness; and wherein the metal material is a metal matrix composite (MMC) material that comprises an aluminum alloy and ceramic particles dispersed in the aluminum alloy.

2. The method of claim 1, wherein the pre-heating is performed by heating a payoff station from which the input is directed towards the rolling mill.

3. The method of claim 1, wherein the pre-heating is performed by running the input through a heated tunnel, wherein the heated tunnel provides heat to the input via conduction, convection, or radiation.

4. The method of claim 1, wherein the pre-heating is performed by contacting a top surface and a bottom surface of the input with heated rolls, wherein the heated rolls do not substantially reduce the thickness of the input.

5. The method of claim 1, wherein the warm rolling is performed to a total % WW of at least 75%.

6. The method of claim 1, wherein the warm rolling is performed by a plurality of warm passes, each warm pass resulting in a % WW of up to 65%.

7. The method of claim 1, wherein the rolling mill comprises a set of heated bite rolls.

8. The method of claim 1, further comprising winding the metal strip into a coil.

9. The method of claim 1, wherein the ceramic particles comprise at least one ceramic material selected from the group consisting of carbides, oxides, silicides, borides, and nitrides.

10. The method of claim 1, wherein the MMC material comprises from 15 vol % to 50 vol % of the ceramic particles.

11. The method of claim 1, wherein the average particle size of the ceramic particles is from 0.3 μm to 5 μm.

* * * * *